United States Patent [19]

Dunbar

[11] 4,418,953

[45] Dec. 6, 1983

[54] MATERIAL HANDLER

[76] Inventor: Glenn G. Dunbar, 2608 Overbrook, Toledo, Ohio 43614

[21] Appl. No.: 231,380

[22] Filed: Feb. 4, 1981

[51] Int. Cl.[3] ..... B66C 19/00; B66C 1/66

[52] U.S. Cl. ..... 294/67 A; 294/81 SF

[58] Field of Search ..... 294/67 A, 67 DA, 67 D, 294/81 R, 81 SF, 88, 103 R, 111, 112, 110; 414/620, 621, 736, 741, 542

[56] References Cited

U.S. PATENT DOCUMENTS

| | | | |
|---|---|---|---|
| 3,006,485 | 10/1961 | Martin | 414/542 |
| 3,514,146 | 5/1970 | Zweifel et al. | 294/67 R |
| 3,789,998 | 2/1974 | Fathauer et al. | 294/67 R |

OTHER PUBLICATIONS

Cargo-Master—Brochure.

*Primary Examiner*—James B. Marbert

*Attorney, Agent, or Firm*—Emch, Schaffer & Schaub, Co.

[57] ABSTRACT

A meterial handler is disclosed in the disclosure. The material handler has a first member and said first member has means for supporting a load. A second member is slideably positioned on the first member and the second member has means for supporting a load. A biasing means is attached to the first and second member. The biasing means acts to maintain the second member in a predetermined position with respect to the first member. Means for lifting the material handler is provided. The lifting means is connected to the second member and slideably connected to the first member. The lifting means is positioned to exert a force on the second member to cause the second member to slide with respect to the first member whereby the position of the support means on the second member will move with respect to the support means of the first member to accommodate various size loads being handled by the material handler.

5 Claims, 11 Drawing Figures

FIG. 1
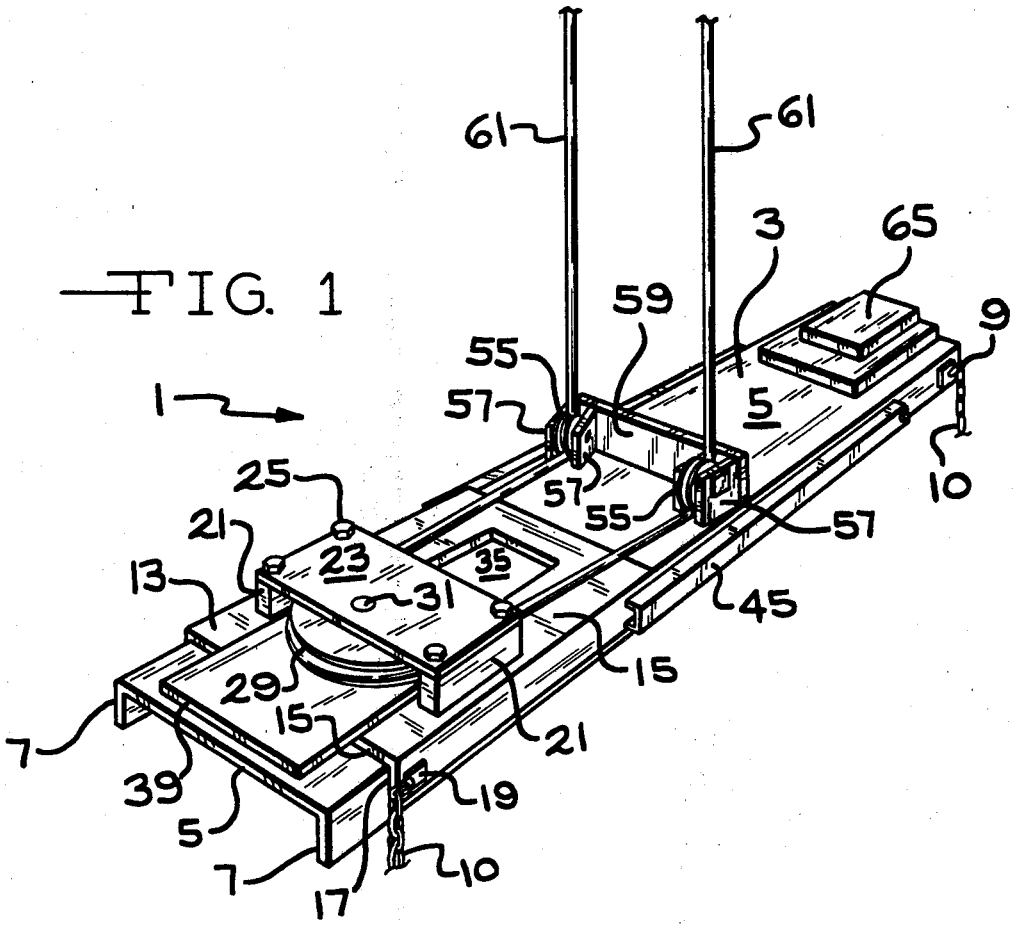
FIG. 4
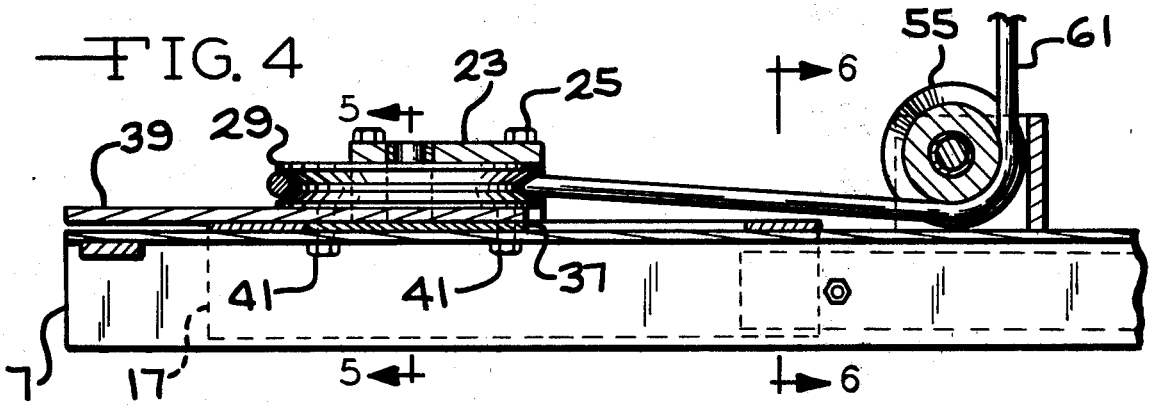
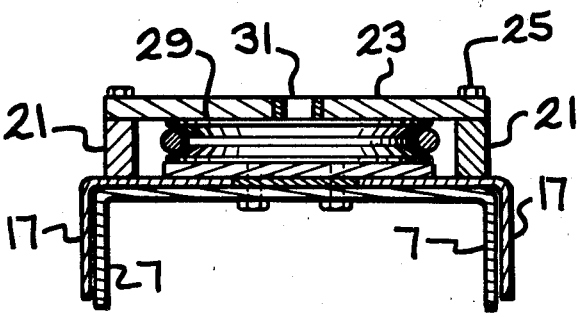
FIG. 5
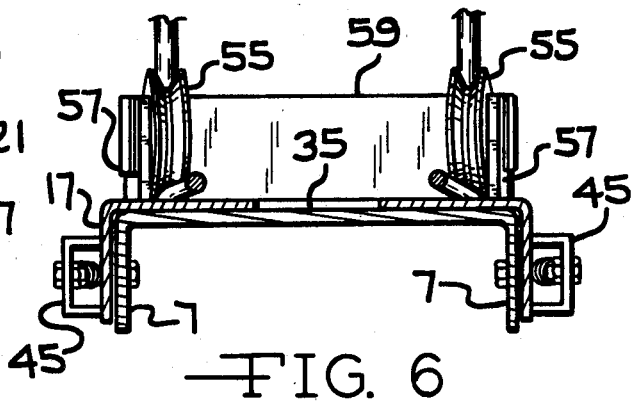
FIG. 6

MATERIAL HANDLER

BACKGROUND OF THE INVENTION

The present invention relates to a material handler for lifting and transporting objects. In one of the more specific aspects of the present invention, the material handler automatically adjusts in length to accommodate various size objects that are to be lifted or transported by the material handler.

Almost all objects at sometime in their distribution chain are transported in tractor trailer rigs. The tractor trailer rigs create a number of problems in transporting the goods and in particular result in loading and unloading difficulties. To facilitate the loading and unloading of objects from a trailer, tracks have been positioned along the upper surface of the trailer and a lifting winch movably positioned along the tracks. A material handler can be connected to the winch to facilitate in the lifting and transporting of the objects within the trailer. The material handlers normally extend across substantially the width of the trailer. Lines or chains extend from the material handler and the chains are connected to the objects in the trailer for lifting and transporting these objects.

The major difficulty with the prior art material handlers is that there is no effective method for adjusting the position of the chains to accommodate various size objects in the trailer. Accordingly, when various size objects are connected to the material handler the objects will not be centered or well balanced with respect to the material handler. The unbalanced objects can place unusual loads on the material handler and be very difficult to lift or transport within the trailer.

Because of the enclosed nature of the trailer and the small amount of space generally available it is frequently not practical to attempt to reposition the chains on the material handler to accommodate various size objects. In some instances, when the objects are particularly large, there is not enough working space to adjust the positioning of the chains to accommodate that object. Therefore, it is desirable to have a material handler than can be utilized in a trailer that automatically adjusts to accommodate the size of the object that is to be lifted or transported within the trailer.

SUMMARY OF THE INVENTION

According to the invention there is provided a material handler having a first member and said first member has means for supporting a load. A second member is slideably positioned on the first member and the second member has means for supporting a load. A biasing means is attached to the first and second member. The biasing means acts to maintain the second member in a predetermined position with respect to the first member. Means for lifting the material handler is provided. The lifting means is connected to the second member and slideably connected to the first member. The lifting means is positioned to exert a force on the second member to cause the second member to slide with respect to the first member whereby the position of the support means on the second member will move with respect to the support means of the first member to accommodate various size loads being handled by the material handler.

An object of the invention is to provide an improved material handler for lifting and transporting objects.

An additional object of the invention is to provide a material handler that automatically adjusts to accommodate various size objects that are being lifted and transported by the material handler.

Other objects and advantages of the invention will become apparent as the invention is described hereinafter in more detail with reference to the accompanying drawings.

DESCRIPTION OF THE DRAWINGS

FIG. 1 is a perspective view of the material handler of the present invention;

FIG. 4 is a cross-sectional view of the invention taken along line 4—4 of FIG. 2;

FIG. 5 is a cross-sectional view of the invention taken along line 5—5 in FIG. 4;

FIG. 6 is a cross-sectional view of the material handler taken along line 6—6 in FIG. 4;

DESCRIPTION OF THE PREFERRED EMBODIMENTS

Figure 2:
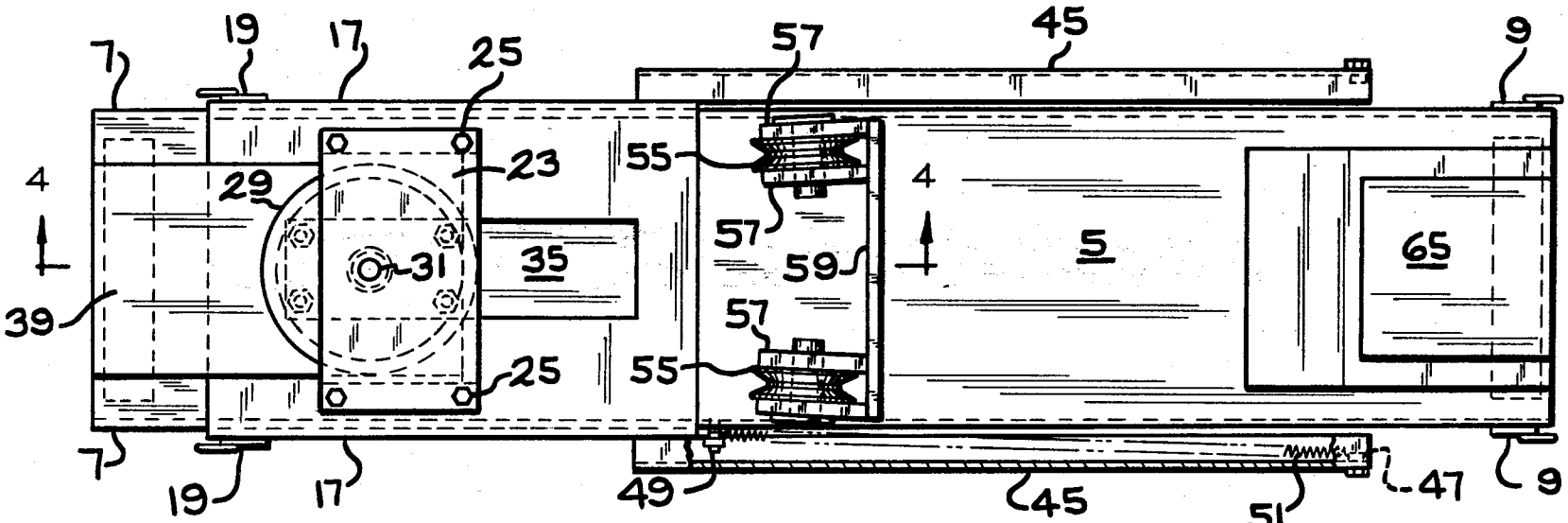
FIG. 2 is a plan view of the material handler.
Figure 3:
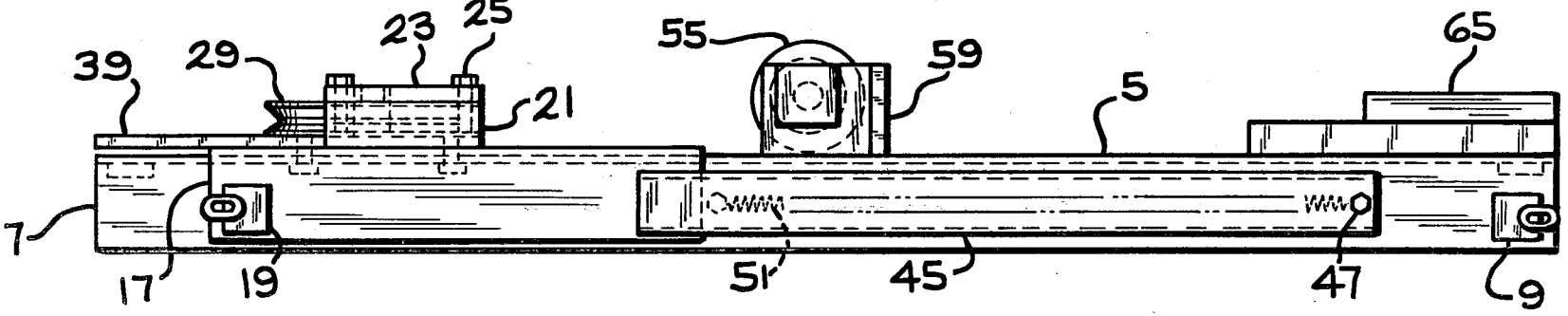
FIG. 3 is a side elevational view of the material handler.
Figure 7:
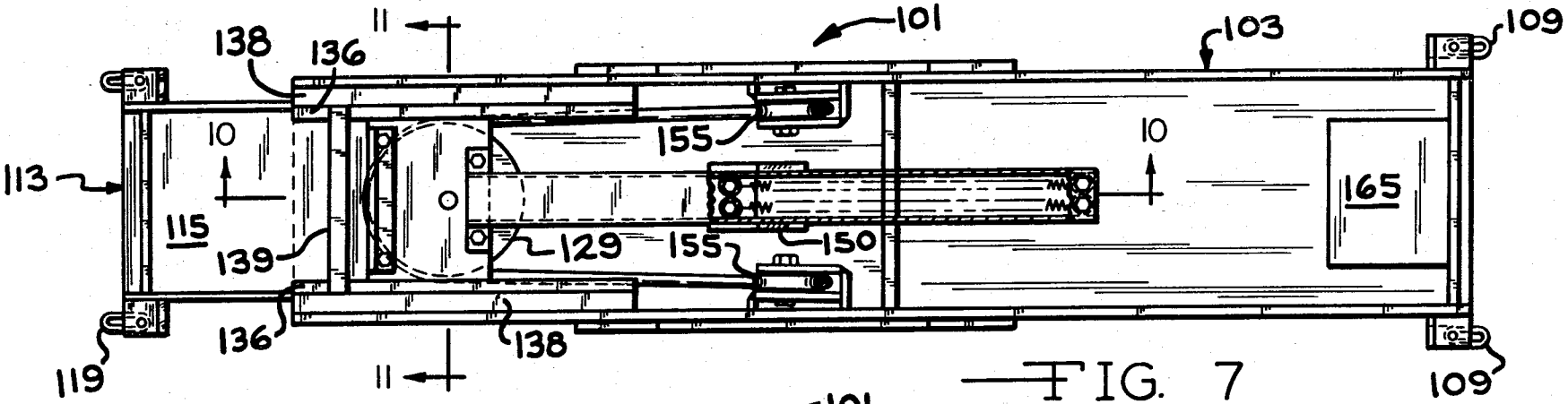
FIG. 7 is a plan view of another embodiment of the material handler of the present invention.

The present invention relates to a material handler that can be utilized in the lifting of objects. More particularly the lifting points on the material handler can be automatically adjusted to compenstate for the size of different objects when these objects are being lifted utilizing the material handler.

The details of the invention will be more readily understood by referring to the attached drawings in connection with the following description.

FIGS. 1–6 show the material handler of the present invention. The material handler 1 has a channel or U-shaped first member 3 having a substantially flat surface 5. Legs 7 project from each side of the flat surface. The legs 7 extend from the flat surface 5 in a direction that is substantially perpendicular to the flat surface 5 of the first member. Lugs 9 are provided on each leg 7 at one end of the first member 3 and the lugs are adapted for receiving chains 10 or other means by which an object can be secured to the material handler for the purposes of lifting or moving the object.

A second channel or U-shaped member 13 is slideably positioned on the first member 3. The second member 13 is substantially the same channel shape as the first member 3 and includes a flat surface 15. Legs 17 extend from each side of the flat surface in a direction that is substantially perpendicular to the flat surface of the second member. Lugs 19 are positioned on one end of the legs 17 on each side of the second member 13. The lugs are adapted to engaged chains 10 or other suitable securement means which can be used to connect an object to the material handler for the purpose of lifting the object.

Positioned on the flat surface 15 of the second member 13 are two support members 21. The support members are positioned along each side of the second member 13 and extend from the surface 15 of the second member in a direction substantially perpendicular to the surface 15. A bridge plate 23 is attached to and extends between the support members 21. As shown in FIG. 1 bolts 25 are used to secure the bridge plate to the support members. However, it should be understood that any suitable securement means could be used to secure the bridge plate 23 to the support members 21. The bridge plate 23 is positioned in substantially parallel relationship to the flat surface 15 of the second member 13. A pulley 29 is positioned between the bridge plate 23 and the surface 15. The pulley is rotatably connected to the bridge plate 23 by means of a pin 31 which extends through the bridge plate 23 into the center hub for the pulley 29. The pin 31 is designed to rotatably position the pulley 29 with respect to the bridge plate 23. The pulley 29 is positioned with the side plates or side walls of the pulley substantially parallel to the flat surface 15 of the second member 13.

The second member 13 contains an opening 35 in the flat surface 15. The opening 35 in the second member extends beneath the pulley 29. Thus, a portion of the first member 3 is exposed through the opening 35 in the second member 13. Positioned in the opening 35 is a spacer 37 that is positioned beneath the pulley 29. A plate 39 is positioned between the spacer 37 and the pulley 29. The spacer 37 and plate 39 are secured to the first member 3 by means of bolts 41. However, it should be noted that other suitable means can be used to secure the spacer and plate to the first member. The plate 39 extends from the pulley 29 in a direction away from the opening 35. The plate extends beyond the end of the second member 13. The plate 39 is secured to the first member 3 and extends over at least a portion of the second member 13. The plate 39 acts as a guide for the movable second member 13 and also prevents the second member from being displaced from the flat surface 5 of the first member 3. The spacer 37 is positioned in the opening 35 to engage the ends of the opening 35 when the second member 13 is moved with respect to the first member 3.

Longitudinal members 45 are positioned adjacent the legs 7 of the first member and the legs 17 of the second member on each side of the material handler. The longitudinal members have a generally U-shaped configuration and are positioned with the U-shaped cavity formed by the members adjacent or facing the legs 17 of the second member. One end of the longitudinal members are connected to the legs 17 of the second members. The other ends of the longitudinal members contain a first attachment means 47. A second attachment means 49 is located on the lugs 7 of the first member 3 adjacent the location where the longitudinal members 45 are connected to the second member 13. A resilient biasing means 51 is attached to and extends between the first and second attachment means. The biasing means 51 is contained in the U-shaped channel defined by the longitudinal member 45.

Positioned on the flat surface 5 of the first member 3 are a pair of pulleys 55. The pulleys are positioned along each side of the flat surface 5 and are rotatably held in position by support braces 57. A support plate 59 is positioned on the flat surface 5 of the first member 3 and in contact with the support braces 57 to add additional support for the pulleys 55. A suitable line 61 passes around one of the pulleys 55, around pulley 29 and around the other pulley 55. The line 61 is connected to any suitable device which is capable of lifting the material handler 1 and any object attached to the material handler.

Weights 65 can be positioned on the flat surface 5 of the first member 3 adjacent the lugs 9 to act as counter weights to balance the material handler.

The operation of the material handler will be more fully understood by referring to the attached drawings in connection with the following description.

Objects that are to be lifted by the material handler are secured to the chains 10 connected to the lugs 9 on the first member 3 and lugs 19 on the second member 13. To lift or move the object one side of the line 61 is collected on a hoist or other suitable collection device. As one side of the line 61 is advanced by the collection means the material handler can be raised or lowered to obtain the desired position for the material handler and the object. As the line 61 is advanced the line will pass around the pulleys 55 located in the support braces 57. The line will also advance around pulley 29 located beneath the bridge plate 23. Depending on the direction in which the line is advanced the material handler will either be raised or lowered.

In normal applications the line 61 will be advanced so that the material handler is lowered to allow the chains 10 to be secured to the object that is to be moved. When the chains are properly positioned, the line 61 is then advanced in a direction to cause the material handler to move in a direction away from the object and to lift the object. The material handler can be connected to additional apparatus that is capable of moving the material handler and the object that is lifted by the material handler so that the object can be transported to different locations.

As the line 61 is advanced to raise or lower the material handler the line will pass around pulleys 55 and pulley 29. The force on the line 61 from the weight of the material handler and the object attached to the material handler will be transmitted to the pulleys 55 and the pulley 29. The pulley 29 is connected to the second member 13 by the support member 21 in such a manner that the force on the line 61 is transferred to the pulley 29 in a manner that the force on the pulley 29 is directed towards the pulleys 55. The second member 13 is slideably positioned on the first member 3 and the force on the line 61 can cause the pulley 29 and second member 13 to be biased toward the pulleys 55. When the material handler is used to lift an object the weight of the object will supply the force on the line 61 that is used to lift the material handler and the object. The magnitude of this weight or force will determine the biasing force that is placed on the pulley 29 and the second member 13 to bias the second member towards the pulleys 55. The biasing force provided by the weight of the object will be offset by the force required to stretch the resilient biasing means 51 located in the longitudinal member 45. The resilient biasing means 51 is attached to the first member 3 at a point adjacent the pulleys 55. The other end of the resilient biasing means is attached to the end of the longitudinal member 45 that is spaced apart from the second member 13. The other end of the longitudinal member 45 is connected to the second member 13. The resilient biasing means 51 exerts a biasing force on the second member 13 that urges the second member 13 away from the pulleys 55.

The movement of the second member 13 is controlled by the spacer 37 that is positioned in the opening 35 in the second member. The spacer 37 is secured to the first member 3 and is not moveable with respect to the first member. Accordingly, the movement of the second member 13 with respect to the first member 3 is controlled by the length of the opening 35. The second member is capable of moving towards the pulleys 55 until the end of the opening 35 engages the spacer 37 and prevents further movement of the second member 13 towards the pulleys. If the second member is moving away from the pulleys 55 this motion can continue until the end of the opening 35 engages the spacer 37 and again prohibits any further movement of the second member 13 away from the pulleys 55. The limitations on the movement of the second member 13 by the spacer 37 are necessary to prevent the second member from coming into contact with the pulleys 55 and to keep the second member from advancing off of the end of the first member 3 in a direction away from the pulleys 55.

During the use of the material handler it is anticipated that objects of varying sizes will be secured to the material handler for lifting and repositioning. In handling these objects it is desirable to have the chain 10 extend vertically to engage the object. If the chains 10 are at an angle or otherwise displaced the connection with the object to be lifted by the material handler will not be as secure and there will be a greater chance of the object causing the material handler to be unbalanced.

In normal use the weight of the material handler is positioned over the object to be lifted and the chains 10 attached to the object. The weight of the material handler normally provides enough force in the line 61 to cause the pulley 29 to advance towards the pulleys 55 until the spacer 37 engages the end of opening 35 adjacent the pulleys 55. The biasing force of the resilient biasing means 51 is not usually sufficient to overcome the force in line 61 from the weight of the material handler.

However, when the material handler is positioned on top of the object, the weight of the material handler is supported by the object and the force in line 61 is significantly reduced. The biasing force of the biasing means 51 will then cause the second member 13 to move away from the pulleys 55 until the spacer 37 engages the end of the opening 35 that is spaced apart from the pulleys 55.

Once the chains 10 are secured to the object the line 61 can be advanced to allow the material handler to move or lift the object. As the line 61 is advanced the force in the line exerts a force on the pulley 29 that causes the pulley and second member 13 to advance towards the pulleys 55. The second member will advance towards the pulleys 55 until the force in the chains 10, from the weight of the objects, is sufficient to balance the force in the line 61. If the chains 10 have been properly positioned on the object the force in the chains 10 will be sufficient to balance the force in line 61 when the chains extend in a substantially vertical direction. Accordingly, the position of the second member 13 will automatically adjust with respect to the first member 3 to position the chains secured to the object in a substantially vertical alignment. Because of this automatic adjustment the material handler can be used on varying size objects and the second member 13 will move with respect to first member 3 to properly position the objects with respect to the material handler.

FIGS. 3, 7–11 show another embodiment of the material handler of the present invention. The material handler 101 has a generally channel or U-shaped first member 103 having a flat surface 105 and legs 107. The legs 107 projects on each side of the flat surface and the legs extend in a direction that is substantially perpendicular to the flat surface 105. Lugs 109 are provided on each leg 107 at one end of the first member 103. The lugs are adapted for receiving chains or other means by which an object can be secured to the material handler for the purposes of lifting or moving the object.

The second channel or U-shaped member 113 is slideably positioned on the first member 103. A second member 113 is substantially the same channel shape as the first member 103 and includes a flat surface 115. Legs 117 extend from each side of the flat surface in a direction that is substantially perpendicular to the flat surface of the second member. Lugs 119 are positioned on one end of the legs 117 on each side of the second member 113. The lugs are adapted to engage chains or other suitable means which can be used to connect an object to the material handler for the purpose of lifting or moving the object.

Positioned on the flat surface 115 of the second member 113 is a support member 121. The support member 121 extends substantially between the two legs 117 of the second member. A bridge plate 123 is attached to and extends between the two legs 117 of the second member 113. The bride plate 123 can be secured to the legs 117 by bolts, welding or any other suitable securement means. The bridge plate 123 is positioned in substantially parallel relationship to the flat surface 115 of the second member 113 and the support member 121. A pulley 129 is positioned between the bridge plate 123 and the support member 121. The pulley is rotatably connected between the bridge plate 123 and the support member 121 by means of a pin 131. The pin extends through the bridge plate 123 through the center hub of the pulley 129 and is secured into the support member 121. The pulley 129 is positioned with the side plate or side walls of the pulley substantially parallel to the flat surface 115 of the second member 113. The support member 121 can be constructed of a material to facilitatte the rotation of the pulley 129.

Positioned along each leg 107 of the first member 103, in the area of the second member 113 are L-shaped brackets 133. The L-shaped brackets have a first leg 135 that is positioned in contact with the legs 117 of the first member. The second leg 136 of the brackets 133 extends from the legs 117 in a direction that is substantially perpendicular to the legs 117. The second legs extend in a direction towards the second member 113 and extend over at least a portion of the legs 117 of the second member. Positioned between the first leg 135 of the L-shaped bracket 133 and the legs 117 of the second member 113 are guides 137. The guides 137 are secured to the first leg 135 of the bracket 133 and are in contact with the legs 117 of the second member 113. The guides 137 are normally constructed of a material that provides a good sliding and wear surface for the legs 117 of the second member 113.

Positioned in contact with the second legs 136 of the bracket 133 and the legs 107 of the first member 103 are braces 138. Positioned between the braces 138 and extending across the second member 113 is bar 139. The bar 139 extends in a direction that is substantially perpendicular to the legs 117 of the second member 113.

Positioned on the bridge plate 123 is an L-shaped stop 141. The L-shaped stop 141 is held in position on the bridge plate by bolts 142. The stop is positioned on the side of the bridge plate that is spaced apart from the pulley 129 and the stop extends from the bridge plate in a direction that is substantially perpendicular to the surface of the bridge plate. The portion of the stop that extends from the bridge plate is positioned to engage the bar 139 when the second member 113 moves toward the bar 139.

A longitudinal member 145 is positioned in contact with the bridge plate 123. The longitudinal member is held in position by bolts 146. The longitudinal member 145 extends from the bridge plate in a direction away from the second member 113. The longitudinal member has a generally U-shaped configuration and is positioned with the U-shaped cavity formed by the member adjacent or facing the flat surface 105 of the first member 103. The end of the logitudinal member that is spaced apart from the bridge 123 contains a first attachment means 147. A second attachment means 149 is connected to a bracket 150 and the bracket is secured to the flat surface 105 of the first member 103. At least one resilient biasing means 151 is attached to and extends between the first and second attachment means. The biasing means 151 is contained in the U-shaped channel defined by the longitudinal member 145.

Positioned on the flat surface 105 of the first member 103 are a pair of pulleys 155. The pulleys are held in position by support braces 157 that are positioned on the flat surface 105 of the first member 103. A line 161 passes around one of the pulleys 155, around pulley 129 and around the other pulley 155. The line 161 is connected to any suitable device which is capable of lifting the material handler 101 and an object attached to the material handler. Weights 165 can be positioned on the flat surface 105 of the first member 103 adjacent the lugs 109 to act as a counter weight to balance the material handler.

The operation of the additional embodiment of the material handler will be more fully understood by referring to FIGS. 7–11 of the attached drawings in connection with the following description.

The material handler 101 functions in essentially the same way as the previously described material handler 1. The primary difference between the material handler 101 and the material handler 1 is that the first member 103 and second member 113 of the material handler 101 have been positioned to reduce the height of the material handler to allow the material handler to be used to lift objects where there is not much clearence around the object.

Figure 8:
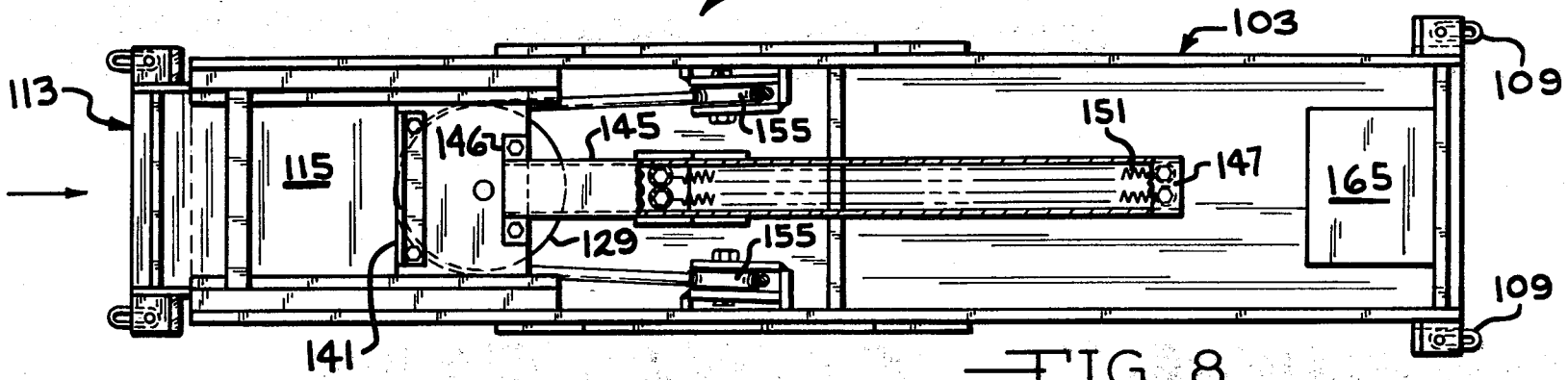
FIG. 8 is a plan view of the material handler of FIG. 7 wherein the components of the material handler are in a different position.
Figure 9:
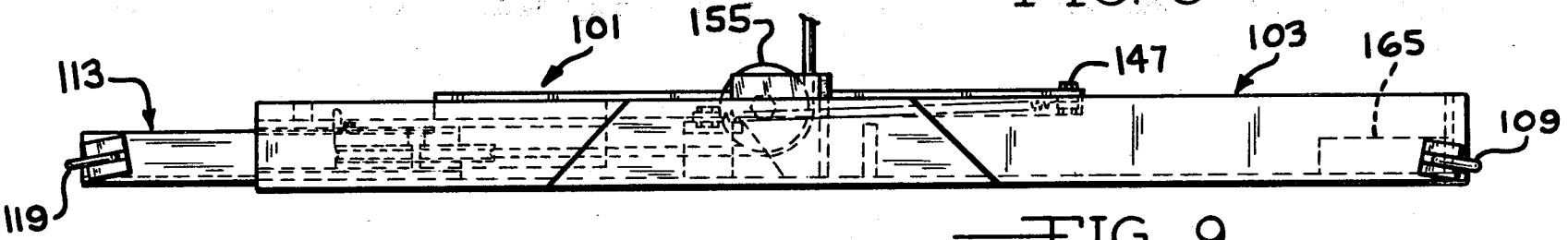
FIG. 9 is a side elevational view of the invention.
Figure 10:
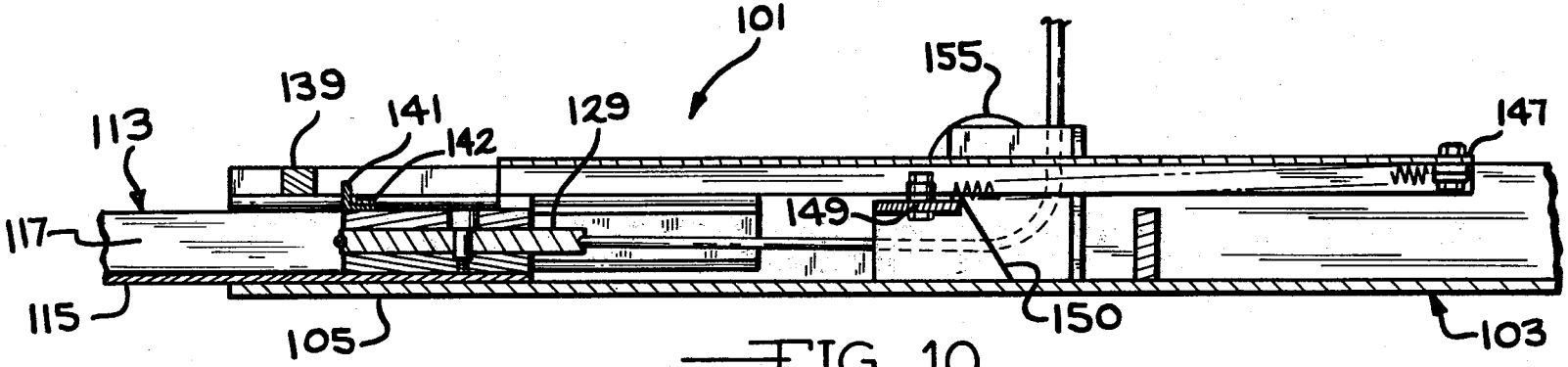
FIG. 10 is a cross-sectional view taken along line 10—10 in FIG. 7.
Figure 11:
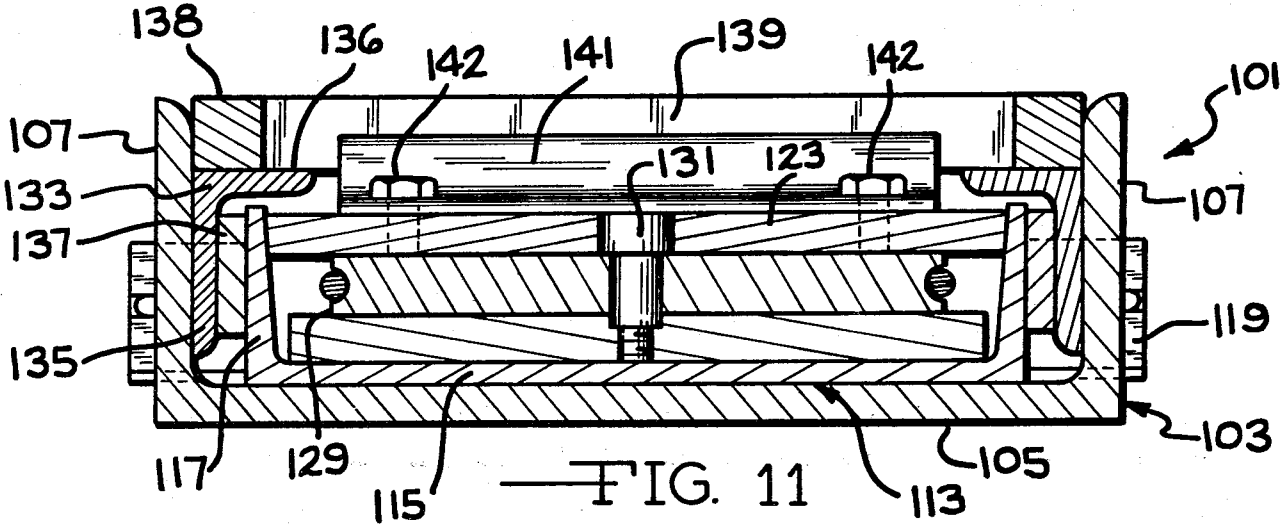
FIG. 11 is a cross-sectional view taken along line 11—11 in FIG. 7.

The material handler 101 contains means for limiting the movement of the second member 113 with respect to the first member 103. The second member 113 will move towards the pulleys 155 in a manner as previously described until the ends of the lugs 119 engage the ends of legs 107 of the first member 103. FIG. 8 shows the lugs 119 in close proximity to the ends of the legs 107 and it can be seen that the second member 113 can not move much further in a direction towards the pulleys 155 before the lugs 119 engage the legs 107. When the second member 113 is moving in a direction away from the pulleys 155 the stop 141 located on the bridge plate 123 comes into contact with the bar 139 and prevents further movement of the second member 113 in a direction away from the pulleys 155.

It should also be noted that the L-shaped brackets 133 have a second leg 136 that extends over the legs 117 of the second member 113. The L-shaped brackets 133 thereby act to prevent the second member 113 from moving in a direction away from the flat surface 105 of the first member 103.

Having described the invention in detail and with reference to the drawings, it is understood that such specifications are given for the sake of explanation. Various modifications and substitutions other than those cited can be made without departing from the scope of the invention as defined by the following claims.

What I claim is:

1. A material handler comprising:

a generally U-shaped first member, said first member having means for supporting a load;

a generally U-shaped second member slideably positioned on said first member, said second member having means for supporting a load, said second member containing an opening;

a spacer positioned on said first member, said spacer positioned in said opening of said second member, said spacer acting to limit the range of movement of said second member with respect to said first member;

biasing means attached to said first and second members, said biasing means acting to maintain said second member in a predetermined position with respect to said first member;

means for lifting said material handler, said lifting means being connected to said second member and slideably connected to said first member whereby said lifting means will exert a force on said second member to cause said second member to slide with respect to said first member whereby the position of said support means on said second member will move with respect to the support means on the first member to accommodate various size loads being handled by said material handler.

2. The material handler of claim 1 wherein a plate is connected to said spacer and said plate extends from said spacer over at least a portion of said second member, said plate acting as a guide for said second member and to maintain said second member in position with respect to said first member.

3. A material handler comprising:

a generally U-shaped first member, said first member having means for supporting a load;

a generally U-shaped second member slideably positioned on said first member, said second member having means for supporting a load;

a rod positioned on said first member;

a stop positioned on said second member, said stop being positioned to engage said rod to limit the movement of said second member with respect to said first member;

biasing means attached to said first and second member, said biasing means acting to maintain said second member in a predetermined position with respect to said first member;

means for lifting said material handler, said lifting means being connected to said second member and slideably connected to said first member whereby said lifting means will exert a force on said second member to cause said second member to slide with respect to said first member whereby the position of said support means on said second member will move with respect to the support means on the first member to accommodate various size loads being handled by said material handler.

4. The material handler of claim 3 wherein lugs are positioned on one end of said second member, said lugs being positioned to engage the end of said first member to limit the movement of said second member with respect to said first member.

5. A material handler comprising;

a generally U-shaped first member, said first member having means for supporting a load;

a generally U-shaped second member slideably positioned on said first member, said second member having means for supporting a load;

substantially L-shaped brackets secured to said first member, one leg of said brackets extending over a portion of said second member to maintain said second member in position with respect to said first member;

biasing means attached to said first and second members, said biasing means acting to maintain said second member in a predetermined position with respect to said first member;

means for lifting said material handler, said lifting means being connected to said second member and slideably connected to said first member whereby said lifting means will exert a force on said second member to cause said second member to slide with respect to said first member whereby the position of said support means on said second member will move with respect to the support means on the first member to accommodate various size loads being handled by said material handler.

* * * * *